US005922979A

United States Patent [19]

Yui

[11] Patent Number: 5,922,979

[45] Date of Patent: Jul. 13, 1999

[54] STRINGED INSTRUMENT

[76] Inventor: Joichi Yui, 19230 Vanowen St., Reseda, Calif. 91335

[21] Appl. No.: 08/884,455

[22] Filed: Jun. 27, 1997

[51] Int. Cl.[6] ..... G10D 3/00

[52] U.S. Cl. ..... 84/291; 84/298; 84/307

[58] Field of Search ..... 84/291, 267, 277, 84/293, 298, 299, 307

[56] References Cited

U.S. PATENT DOCUMENTS

| | | | |
|---|---|---|---|
| 1,564,078 | 12/1925 | Lock | 84/294 |
| 2,031,706 | 2/1936 | Hambrecht et al. | 84/294 |
| 2,523,963 | 9/1950 | Mitchell | 84/267 |
| 4,867,029 | 9/1989 | Lorenzen et al. | 84/277 |

*Primary Examiner*—William M. Shoop, Jr.
*Assistant Examiner*—Shih-yung Hsieh
*Attorney, Agent, or Firm*—James E. Brunton

[57] ABSTRACT

A stringed instrument having a hollow body including a top wall, a spaced apart bottom wall, and a side wall interconnecting the top and bottom wall, each of the walls having a plurality of strategically located sound holes which efficiently release sound vibrations generated within the hollow body of the instrument. The stringed instrument also includes an extended bridge disposed internally of the hollow body and interconnecting the top and bottom walls in a manner to transmit vibrations formed in the top wall to the bottom wall thereby making two sound boards increasing vibration and in so doing increasing sound dynamics and volume of the instrument.

14 Claims, 4 Drawing Sheets

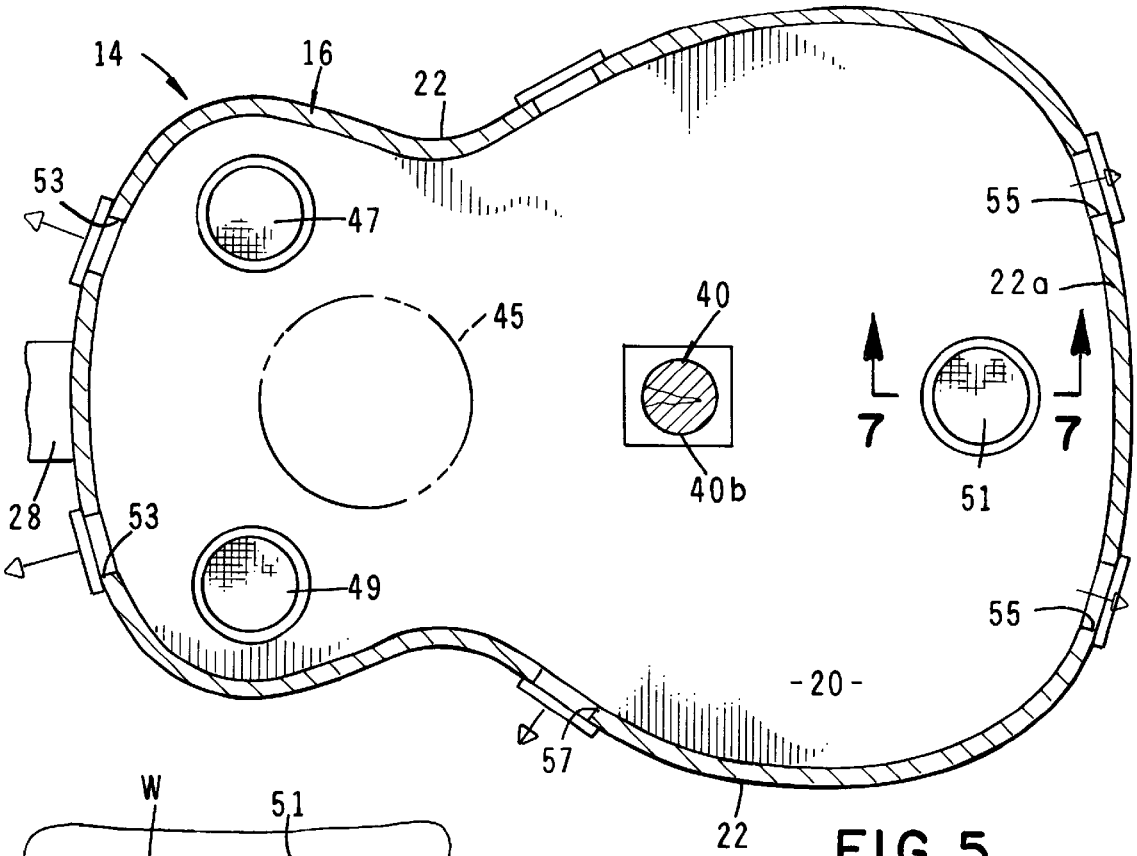
FIG. 5
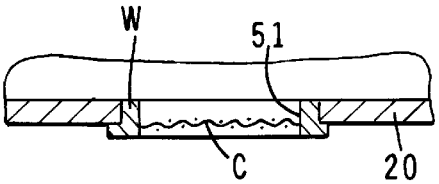
FIG. 7
FIG. 6
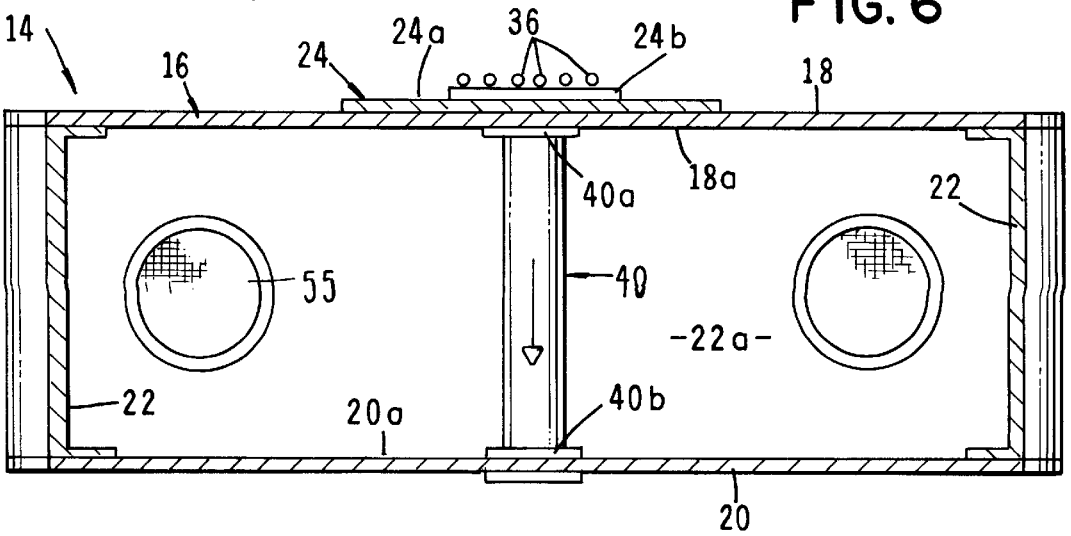

STRINGED INSTRUMENT

BACKGROUND OF THE INVENTION

1. Field of the Invention

The present invention relates generally to improvements in the design of stringed instruments. More particularly, the invention concerns an improvement for stringed musical instruments in the family comprising the guitar, the mandolin and the lute.

2. Discussion of the Prior Art

Stringed instruments produce sound by controlled vibration of stretched strings. This may be done by drawing a bow across the strings as in the violin, or by plucking the strings as in the harp and guitar. Typically, the stringed instrument comprises a hollow wooden body, a long neck connected to the wooden body and at least four strings extending along the length of the body. In the case of the guitar, the mandolin and the lute, plucking the strings creates vibrations which are transmitted to the hollow body causing the hollow body to vibrate, thereby amplifying and enriching the sound produced. The pitch of the note produced by any stringed instrument depends upon the length, weight and tension of the string with a shorter, lighter or tighter string producing a higher note.

One of the most popular of the stringed instruments is the acoustic guitar. Like other stringed instruments, the acoustic guitar comprises a hollow body, a neck connected to the hollow body, and typically six or twelve strings extending along the length of the neck of the instrument. At one end, the strings are connected to a bridge which in turn is connected to the upper wall of the hollow body. The opposite end of the strings are connected to machine heads which are carried by a head stock that is provided proximate the outboard end of elongated neck. Disposed intermediate the bridge and the head stock, is a sound hole or aperture formed in the hollow body immediately below the tensioned strings.

In the traditional guitar, the sound hole faces the audience and in a direction away from the player. Accordingly, the player does not hear the full volume or tonal qualities of his instrument due to the fact that the player is situated behind the instrument. This situation is similar, for example, to listening to a person talking while their back is turned. The spoken words would be more audible and more pleasurable to listen to if the conversation were face to face. Additionally, in the traditional guitar, the source of the sound vibrations are centered at the bridge of the instrument. When the strings are plucked, the bridge transfers the sound vibrations to the rest of the hollow body or "sound box" and every inch of the sound box then vibrates and emits its particular sound wave. In an instrument such as the guitar, the sound vibrations are compressed and trapped within the instrument and are only released from the single sound hole which is traditionally located on the top of the hollow body at a location beneath the tensioned strings.

The thrust of the present invention is to provide a stringed instrument, such a guitar, that emits superior sound effects as a result of the combination between a bridge of radically new design and a hollow body or sound box of an improved design having a plurality of sound holes located at strategic locations on the top, bottom and along the sides of the hollow body. By strategically locating the sound holes or sound ports, at spaced apart locations on the hollow body, a pleasing stereo sound effect is achieved due to the fact that, depending on the location of the sound port, the volume and tonal quality of the sound vibrations released are different. This is because the source of the vibrations are centered at the bridge of the instrument. Therefore, sound ports near the bridge will sound differently from sound ports located further away. Also, the spaced apart sound ports of the instrument will project sound frequencies as a function of their proximity to different gauged strings. For example, a sound port located near a 0.052 gauge string will emit stronger bass frequencies than a sound port situated further away. Similarly, a sound port situated closer to a high, 0.012 gauge string will project a higher frequency vibration.

An additional advantage of the multi sound hole design of the hollow body of the stringed instrument of the present invention resides in the fact that better sound recognition is achieved for the player of the instrument. More particularly, due to the unique design of the hollow body of the instrument of the present invention, the player is better able to hear sound vibrations emanating from various locations. Accordingly, the player's tone recognition coupled with the clarity of the sounds emanating from the hollow body will enable the player to enjoy radically improved sound recognition. Additionally, by locating the sound holes at various locations on the top, sides and back of the instruments, sound vibrations will be emitted in different directions, thereby creating a "surround sound" effect, which is both pleasing to the audience and of substantial assistance to the artist in his recognition of the sound and tonal qualities coming from the instrument.

Contributing to the enhanced capabilities of the stringed instrument having the multi sound hole, hollow body design, is the novel design of the bridge of the instrument. More particularly, the bridge of one form of the instrument of the present invention comprises an extended bridge that extends from the bottom of the standard-bridge to the bottom wall of the instrument. This extended bridge may take the form of a cylindrically shaped solid member or alternatively, a hollow tubular member. With this construction when the strings are plucked the bridge vibrates the top board of the instrument and the extended bridge functions to transfer the same vibrations to the back board making it vibrate as well. This direct connection between the top and bottom walls of the hollow body makes the two walls or sound boards vibrate instead of only one as in the conventional instrument. As a result, substantially improved volume and sound dynamics are achieved.

SUMMARY OF THE INVENTION

It is an object of the present invention to provide a stringed instrument having a hollow body including a top wall, a spaced apart bottom wall, and a side wall interconnecting the top and bottom wall, each of the walls having a plurality of strategically located sound holes which efficiently release sound vibrations generated within the hollow body of the instrument.

Another object of the invention is to provide a string type musical instrument having a hollow body provided with a plurality of sound holes which are strategically located to enable the player to better hear the sound produced when the instrument is played.

Another object of the invention is to provide a string type musical instrument of the aforementioned character having a hollow body provided with a plurality of sound holes which are strategically located to also provide a greater volume of sound than conventional string type instruments having only a single sound hole in the top wall of the hollow body.

Another object of the invention is to provide a string type musical instrument of the character described in the preceding paragraphs in which the hollow body has a top wall, a bottom wall, and a side wall interconnecting the top and bottom wall, the sound holes being located at spaced apart locations in each of the top, bottom and side walls of the hollow body to produce a surround sound effect as the instrument is played.

Another object of the invention is to provide a musical instrument as described in the immediately proceeding paragraph which includes an extended bridge disposed internally of the hollow body and interconnecting the top and bottom walls in a manner to transmit vibrations formed in the top wall to the bottom wall thereby making two sound boards increasing vibrating and in so doing increasing sound dynamics and volume of the instrument.

Another object of the invention is to provide a musical instrument, such as a guitar which has superior volume and sound dynamics and one which is attractive in appearance and easier for the musician to play because of the ability of the musician to hear sound vibrations with better tone recognition, volume and clarity.

BRIEF DESCRIPTION OF THE DRAWINGS

FIG. 5 is a cross-sectional view taken along lines 5—5 of FIG. 3.

FIG. 6 is an enlarged cross-sectional view taken along lines 6—6 of FIG. 3.

FIG. 7 is an enlarged cross-sectional view taken along lines 7—7 of FIG. 3.

DESCRIPTION OF THE INVENTION

Figure 1:
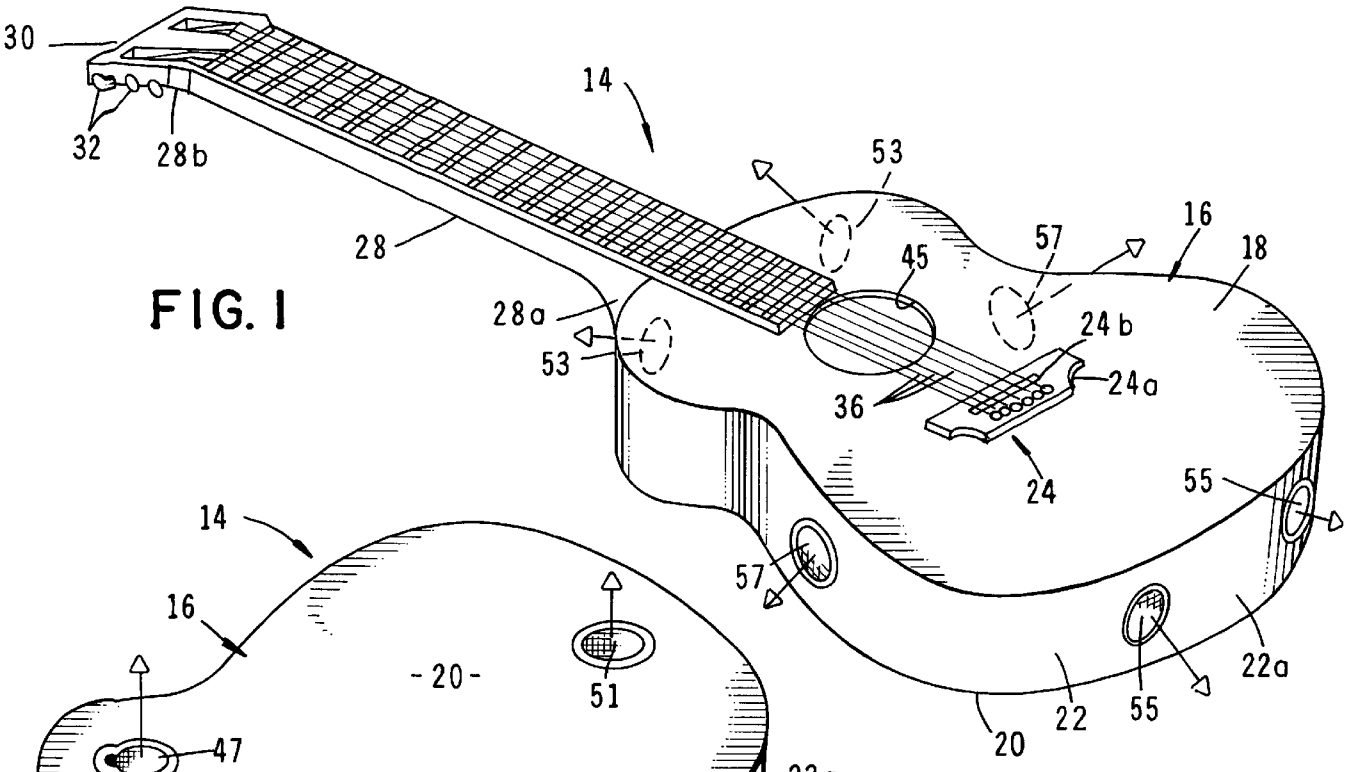
FIG. 1 is a generally perspective top view of a stringed instrument of one form of the invention.
Figure 2:
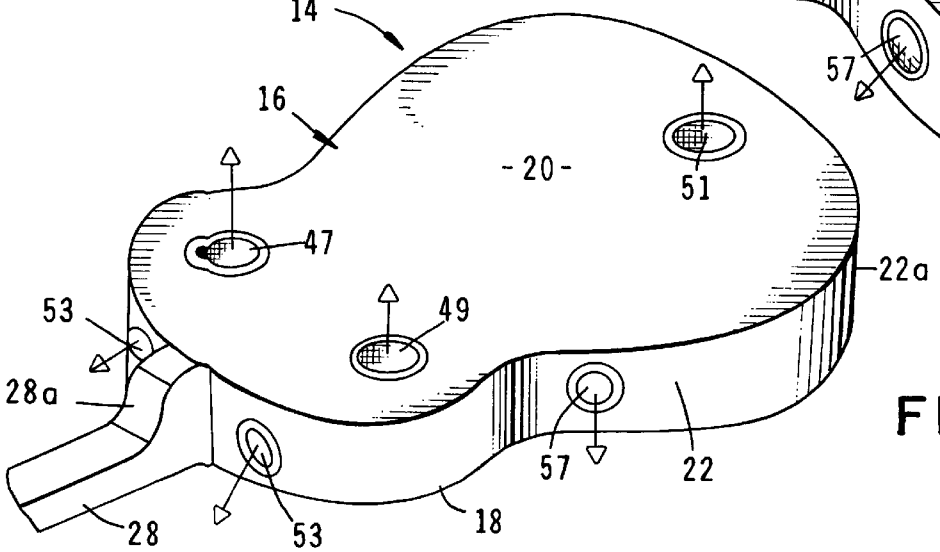
FIG. 2 is a generally perspective bottom view of the stringed instrument shown in FIG. 1.

Referring to the drawings and particularly to FIGS. 1 and 2, one form of the musical instrument of the present invention is there shown and generally identified by the Numeral 14. Musical instrument 14 includes a hollow body 16, having a top wall 18, a spaced apart bottom wall 20 and a continuous side wall 22, which interconnects top wall 18 with bottom wall 20.

Connected to top wall 18 of the hollow body is a bridge assembly 24. Bridge assembly 24 is of conventional construction and includes a base portion 24*a* and an upstanding string supporting member 24*b* (FIG. 6), an elongated neck 28 is connected to body portion 16 proximate its first end 28*a*. Neck 28 is also provided with a second end 28*b* which terminates in a head stock 30. Connected to head stock 30 are string connector means shown here as a plurality of adjustable machine heads 32, the purpose of which will presently be described.

A plurality of strings 36 of conventional construction are connected at one end to bridge 24, and at their opposite end to the string connector means of machine heads 32. In a conventional manner, machine heads 32 can be manipulated to increase or decrease the tension of the strings 36.

An important feature of one form of the musical instrument of the present invention comprises an extended bridge 40, which as best seen in FIG. 6, is disposed internally of hollow body 16 and extends between the lower surface 18*a* of top wall 18, and upper surface 20*a* of bottom wall 20. Preferably, the upper end 40*a* of extended bridge 40 is in close proximity with base 24*a* of bridge 24 in the manner shown in FIG. 6. The opposite end 40*b* of extended bridge 40 is in engagement with upper surface 20*a* of bottom wall 20. With this arrangement, vibrations generated in bridge assembly 24 and in top wall 18 of the musical instrument will be transmitted via extended bridge 40 to bottom wall 20 causing the bottom wall to vibrate along with top wall 18.

The extended bridge can take several forms but preferably is a generally, cylindrically shaped member having its upper portion disposed proximate bridge base 24*a*, and its lower portion in engagement with surface 20*a* of base wall 20.

Figure 8:
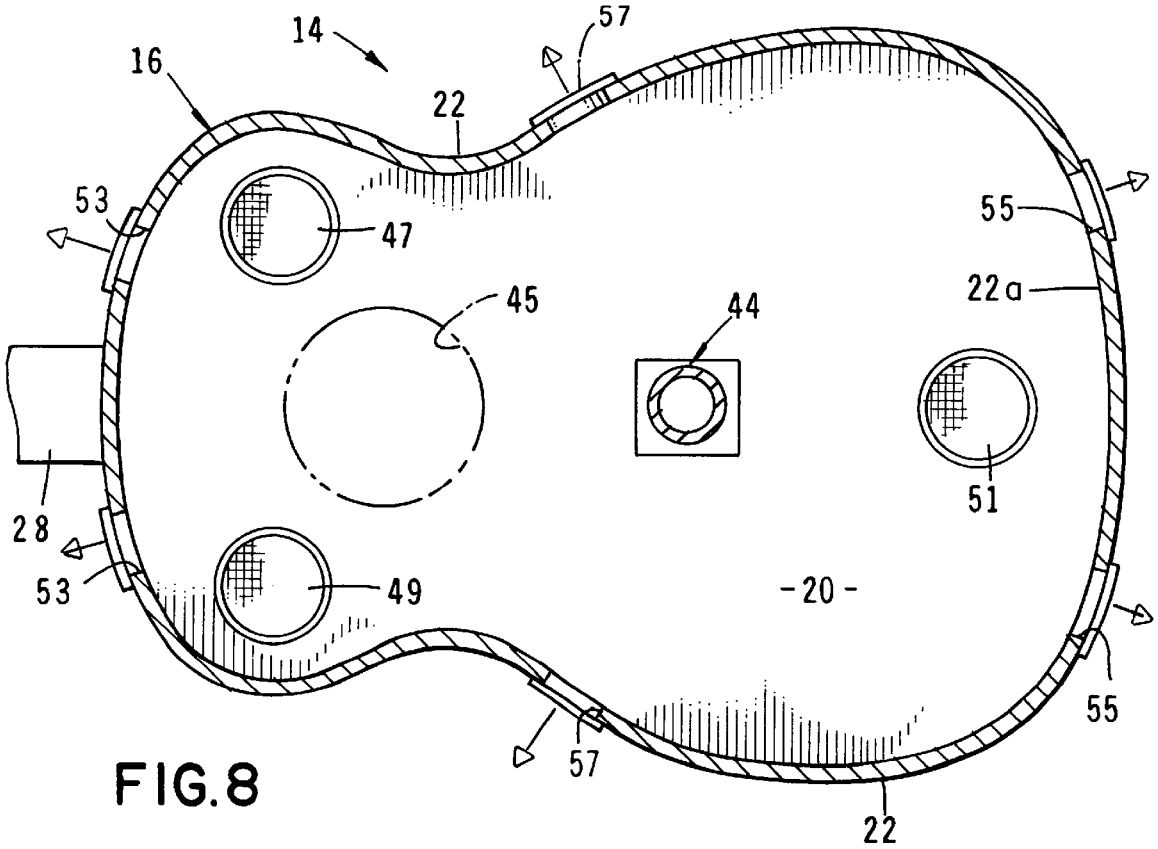
FIG. 8 is a cross-sectional view similar to FIG. 5 showing an alternate form of the invention.
Figure 9:
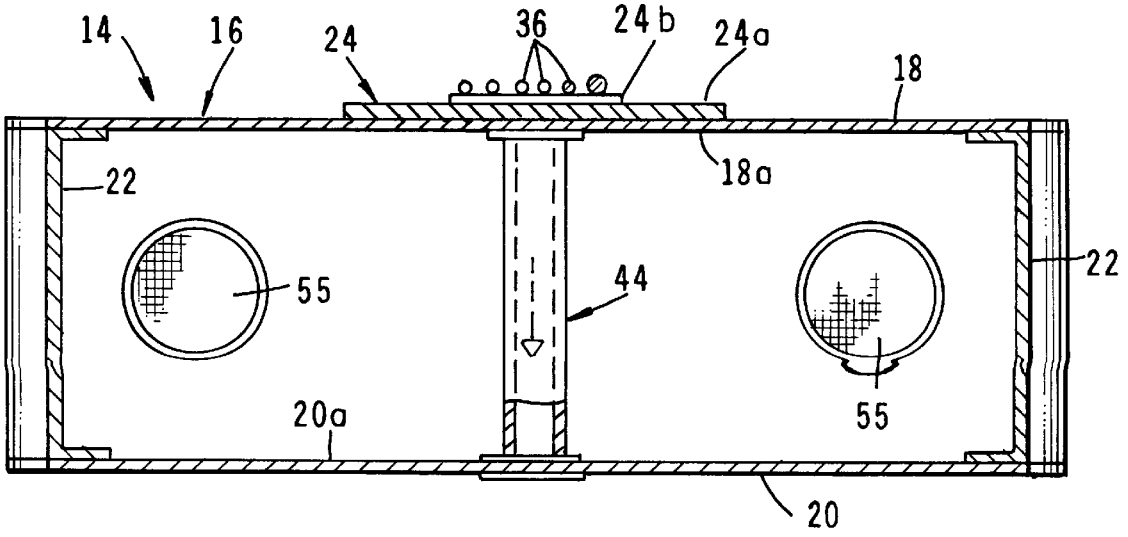
FIG. 9 is a cross-sectional view similar to FIG. 6 also showing the alternate form of the invention.

In the alternate embodiment of the invention shown in FIGS. 8 and 9, extended bridge 44 takes the form of a generally tubular shaped hollow member having an upper end in engagement with base 24*a* of bridge 24, and lower end in engagement with surface 20*a* of bottom wall 20. This tubular shaped extended bridge also functions to transmit vibrations from top wall 18 to bottom wall 20.

Another extremely important aspect of the musical instrument of the present invention is the placement of a plurality of strategically located sound holes in the top, bottom and side walls of the housing 16. As previously mentioned, most conventional musical instruments have a single sound hole provided in the top wall of the hollow body at a location directly below the plurality of strings 36. Such a hole is identified in FIG. 1 by the numeral 45. In the present form of the invention, this single hole 45 is supplemented by a plurality of holes formed in bottom wall 20 (FIG. 2). In the embodiment of the invention shown in FIG. 2, these holes comprise a pair of holes 47 and 49, which are provided in the bottom wall at transversely spaced apart locations on either side of neck portion 28. A third sound hole 51 is also provided in bottom wall 20 at a central location proximate the opposite end of wall 20 from sound holes 47 and 49.

Figure 3:
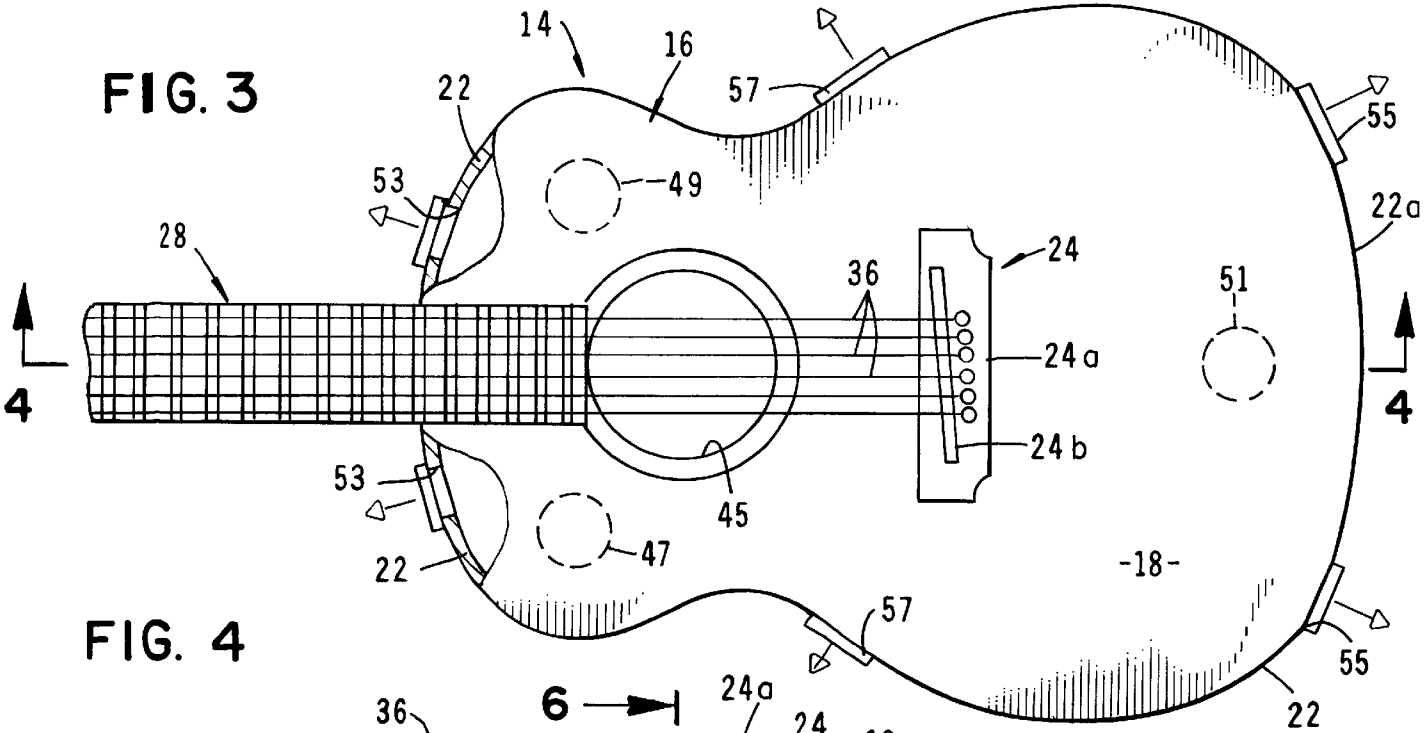
FIG. 3 is a foreshortened top plan side view of the musical instrument shown in FIG. 1.
Figure 4:
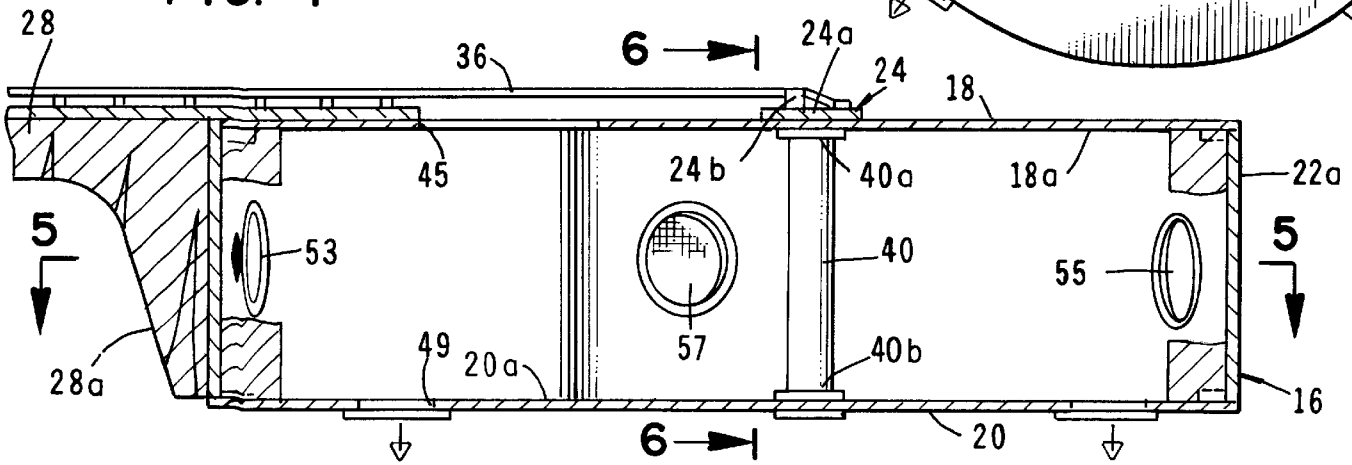
FIG. 4 is a cross-sectional view taken along lines 4—4 of FIG. 3.

In addition to the plurality of sound holes provided in bottom wall 20, a plurality of sound holes are provided in side wall 22. In the present form of the invention, these sound holes comprise a pair of sound holes 53 which are located in side wall 22 proximate neck 28. Similarly, a pair of sound holes generally designated by the numeral 55 are provided in the rear portion 22*a* of side wall 22 in the manner best seen in FIGS. 1 and 3. Additionally, a pair of sound holes 57 are provided in side walls 22 proximate the center point of the side walls. With sound holes thusly situated on the sides and bottom of the hollow body, substantially more vibrations are released from the instrument thereby achieving greater overall volume. Additionally, as previously mentioned, the sound holes in the side and back walls of the hollow body are strategically located to create a highly novel surround sound effect and at the same time permit the musician to more clearly hear the sound vibrations emanating from the hollow housing with better tone recognition, volume and clarity.

As shown in FIG. 7, each of the sound holes comprises a wall "w" defining the sound hole. Covering each hole is a fabric or plastic cover "c" which is affixed to wall "w". With the novel construction of the musical instrument shown in the drawings, when the strings 36 of the instrument are plucked the bridge 24 transfers the sound vibrations to the rest of the hollow housing. More particularly, every inch of the hollow housing vibrates and emits its own particular sound wave. Accordingly, the sound holes located near the bridge will sound differently from the sound holes located at a spaced apart distance from the bridge. Also the various sound holes will project sound frequencies as a function of their proximity to the particular strings 36. For example, a sound port located near a 0.052 gauge string will emit stronger base frequencies than a sound hole situated further away. In similar fashion. a sound hole situated closer to a high 0.012 gauge string will project a higher frequency. When the vibrations set up in the hollow body by plucking of the strings is simultaneously released by the various sound holes provided in the hollow body, a highly original and unique sound and tonal quality from the instrument is achieved.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. A musical instrument comprising:

(a) a hollow body having a top wall, a spaced apart bottom wall and a side wall interconnecting said top and bottom wall, said top wall being provided with at least one top sound hole and said side wall being provided with a plurality of spaced apart sound holes;

(b) an elongated neck connected to said hollow body and extending therefrom, said neck having first and second ends;

(c) string connector means provided proximate said first end of said neck;

(d) a bridge connected to said top wall of said hollow body at a location proximate said top sound hole; and (e) a plurality of strings connected at one end to said string connector means and connected proximate the other end with said bridge, said strings overlaying said elongated neck.

2. A musical instrument as defined in claim 1 in which said bottom wall of said hollow body is provided with at least one bottom sound hole.

3. A musical instrument as defined in claim 1 in which said top wall of said hollow body is provided with a plurality of spaced apart top sound holes and in which said bottom wall of said housing is provided with a plurality of spaced apart bottom sound holes.

4. A musical instrument as defined in claim 1 further comprising an extended bridge disposed internally of said hollow body and extending between said bridge and said bottom wall of said hollow body.

5. A musical instrument as defined in claim 4 in which said extended bridge comprises a generally cylindrically shaped member.

6. A musical instrument as defined in claim 4 in which said extended bridge comprises a tubular member.

7. A musical instrument comprising:

(a) a hollow body having a top wall, a spaced apart bottom wall and a side wall interconnecting said top and bottom wall, said top wall being provided with a plurality of spaced apart top sound holes and said side and bottom walls being provided with a plurality of spaced apart sound holes;

(b) an elongated neck connected to said hollow body and extending therefrom, said neck having first and second ends;

(c) a head stock connected to said neck;

(d) string connector means adjustably connected to said head stock;

(e) a bridge connected to said top wall of said hollow body at a location proximate said top sound hole;

(f) a plurality of strings connected at one end to said string connector means and connected proximate their opposite end to said bridge; and (g) an extended bridge disposed internally of said hollow body and extending between said top wall proximate said bridge and said bottom of said hollow body.

8. A musical instrument as defined in claim 7 in which said extended bridge comprises a generally cylindrically shaped member.

9. A musical instrument as defined in claim 7 in which said extended bridge comprises a cylindrical shaped member.

10. A musical instrument as defined in claim 7 in which said extended bridge is disposed directly below said bridge and extends generally perpendicularly from said top wall of said hollow body.

11. A musical instrument comprising:

(a) a hollow body having a top wall, a spaced apart bottom wall and a side wall interconnecting said top and bottom wall, said top wall being provided with a first top sound hole and said bottom wall being provided with at least one sound hole;

(b) a bridge connected to said top wall of said hollow body at a location proximate said first top sound hole;

(c) an elongated neck having a first end connected to said hollow body and a second end terminating in a head stock;

(d) a plurality of machine heads connected to said head stock;

(e) a plurality of strings, each having one end connected to said bridge and having an opposite end connected to a selected one of said machine heads; and (f) an extended bridge disposed internally of said hollow body and extending between said top and bottom wall of said hollow body, said extended bridge being disposed beneath said bridge.

12. A musical instrument comprising:

(a) a hollow body having a top wall, a spaced apart bottom wall and a side wall interconnecting said top and bottom wall, said top wall being provided with a first top sound hole and said side wall being provided with a plurality of spaced-apart sound holes;

(b) a bridge connected to said top wall of said hollow body at a location proximate said first top sound hole;

(c) an elongated neck having a first end connected to said hollow body and a second end terminating in a head stock;

(d) a plurality of machine heads connected to said head stock;

(e) a plurality of strings, each having one end connected to said bridge and having an opposite end connected to a selected one of said machine heads; and (f) an extended bridge disposed internally of said hollow body and extending between said top and bottom wall of said hollow body, said extended bridge being disposed beneath said bridge.

13. A musical instrument as defined in claim 12 in which said bottom wall is provided with a plurality of spaced apart sound holes.

14. A musical instrument comprising:

(a) a hollow body having a top wall, a spaced apart bottom wall and a side wall interconnecting said top and bottom wall, said top wall being provided with a first top sound hole and said side wall being provided with at least one sound hole;

(b) a bridge connected to said top wall of said hollow body at a location proximate said first top sound hole;

(c) an elongated neck having a first end connected to said hollow body and a second end terminating in a head stock;

(d) a plurality of machine heads connected to said head stock;

(e) a plurality of strings, each having one end connected to said bridge and having an opposite end connected to a selected one of said machine heads; and (f) an extended bridge disposed internally of said hollow body and extending between said top and bottom wall of said hollow body, said extended bridge being disposed beneath said bridge.

* * * * *